United States Patent [19]

Luca, Jr. et al.

[11] 4,220,385

[45] Sep. 2, 1980

[54] ELECTRICAL CONNECTOR

[75] Inventors: Vincent A. Luca, Jr., Sidney; Carl L. Knapp, Oneonta; Alan L. Schildkraut, Sidney, all of N.Y.

[73] Assignee: The Bendix Corporation, Southfield, Mich.

[21] Appl. No.: 16,719

[22] Filed: Feb. 28, 1979

[51] Int. Cl.[3] ..... H01R 13/48; H01R 13/58

[52] U.S. Cl. ..... 339/59 M; 339/103 M

[58] Field of Search ..... 339/59 R, 59 M, 60 R, 339/60 M, 94 R, 94 M, 103 R, 103 M

[56] References Cited

U.S. PATENT DOCUMENTS

| | | | |
|---|---|---|---|
| 2,411,861 | 12/1946 | Antony, Jr. et al. | 339/60 M |
| 2,563,762 | 8/1951 | Uline et al. | 339/60 M |
| 2,700,140 | 1/1955 | Phillips | 339/94 M |
| 2,896,186 | 7/1959 | Hardmark | 339/94 M |
| 3,182,278 | 5/1965 | Bridle | 339/59 M |
| 3,241,095 | 3/1966 | Phillips | 339/94 M |

FOREIGN PATENT DOCUMENTS

| | | | |
|---|---|---|---|
| 1047326 | 11/1966 | United Kingdom | 339/59 R |

*Primary Examiner*—Neil Abrams

*Attorney, Agent, or Firm*—Raymond J. Eifler; Charles D. Lacina

[57] ABSTRACT

An electrical connector assembly having a plastic disc (30) adjacent a moisture sealing grommet (20) to prevent radial forces applied to a wire (40) entering the grommet from deflecting the passage (21) in the grommet and allowing moisture to enter the passage (21).

7 Claims, 5 Drawing Figures

FIG. 5
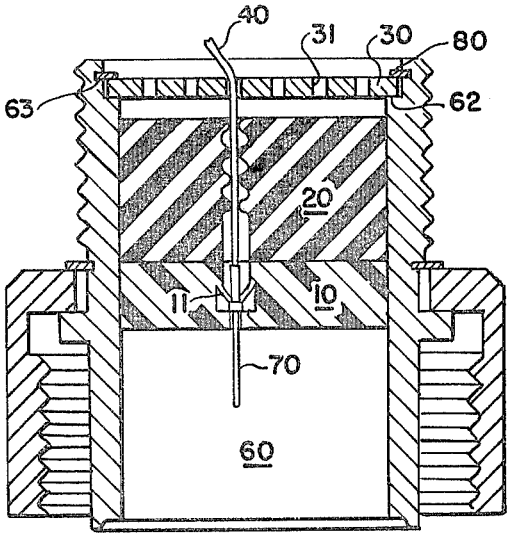
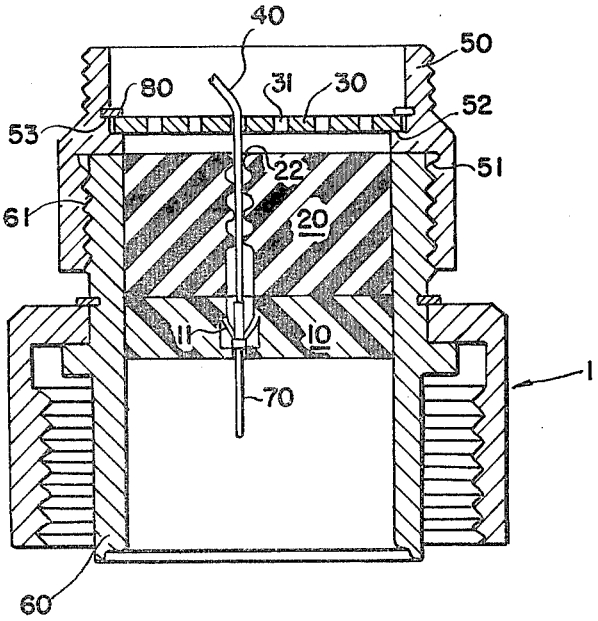
FIG. 4

ELECTRICAL CONNECTOR

BACKGROUND OF THE INVENTION

This invention relates to electrical connectors of the type having insertable and removable electrical contacts. The invention is more particularly related to a strain relief disc located adjacent a moisture sealing grommet.

Electrical connectors generally include a plug and receptacle, each of which has an insert of dielectric material provided with multiple opening within which electrical contacts are retained. The insert is introduced from the rearward end of the metallic shell where it is held in place by an adhesive bond. Some connectors provide for rear insertion and release of electrical contacts while other connectors provide for front insertion and release of electrical contacts. These features are desirable and facilitate the assembly and servicing of a connector. Examples of prior art electrical connectors having insertable and removable contacts may be found in U.S. Pat. No. 3,165,369 entitled "Retention System For Electrical Contacts" issued Jan. 12, 1966; and U.S. Pat. No. 3,221,292 entitled "Electrical Connector" issued June 30, 1965.

In many of these types of connectors it is desirable to provide a moisture sealing grommet adjacent the contact retaining insert at the receiving end of the connector to seal out moisture which would otherwise enter the connector along the wires attached to the contacts. An example of such a moisture sealing grommet may be found in U.S. Pat. No. 4,082,398 entitled "Electrical Connector With Front and Rear Insertable and Removable Contacts" issued Apr. 4, 1978. To prevent the wires from being separated from the contacts, when an axial force is applied to the cable containing wires, many of these types of connector employ strain relief devices. One example of a typical strain relief that can be utilized with these types of electrical connectors may be found in U.S. Pat. No. 3,792,417 entitled "Strain Relief Clamp For an Electrical Connector", issued Feb. 12, 1974.

The invention is an electrical connector assembly characterized by a disc (30) having a plurality of apertures (31) therein located adjacent to a moisture sealing grommet (20) to prevent wires (40) leaving the bores (21) of the moisture sealing grommet from being displaced from the axis of the bores (21) thereby preventing distortion of the grommet bores (21) that would have allowed moisture to enter the connector.

Accordingly, it is an object of this invention to provide a disc for an electrical connector which will prevent the wires entering a connector from being displaced from axial alignment with the bores in a moisture sealing grommet.

It is another object of this invention to improve the moisture sealing characteristics of an electrical connector.

The above and other objects and features of the invention will become apparent from the following detailed description taken in conjunction with the accompanying drawings and claims which form a part of this specification. Further, the use of numerals is for the purpose of clarification only and is not intended to limit the specific structure illustrated.

BRIEF DESCRIPTION OF THE DRAWINGS

FIG. 4 illustrates a preferred embodiment of the invention.

FIG. 5 illustrates an alternate embodiment of the invention.

DETAILED DESCRIPTION OF THE DRAWINGS PRIOR ART

Figure 1:
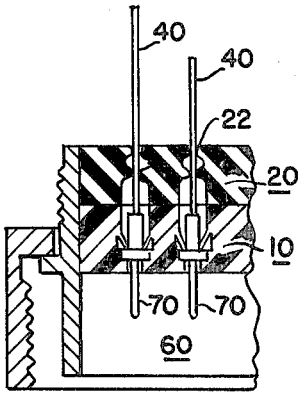
FIG. 1 PRIOR ART
FIGS. 1, 2 and 3 illustrate prior art electrical connector assembly having the problem that this invention prevents.

FIG. 1 illustrates a partial diagrammatic view of an electrical connector assembly 1 which includes a housing 60 having mounted therein a contact retaining insert 10 for retaining contacts 70 and a moisture sealing grommet 20. The contact retaining insert 10 is generally comprised of a rigid material such as plastic. The moisture sealing grommet 20 is generally comprised of a resilient material such as rubber. Connected to each of the contacts, sometimes as many as 100 contacts, are wires 40. In this figure the wire 40 is not deflected from the axis of the contact and enters the moisture sealing grommet 20 through passage 22. The walls of each passage 22 are designed to make pressure contact with a wire 40 in the passage to prevent moisture from entering the connector. Should moisture enter the connector an electrical path would eventually be established between the mating surfaces of adjoining contact 70 and electrical failure would result.

Figure 2:
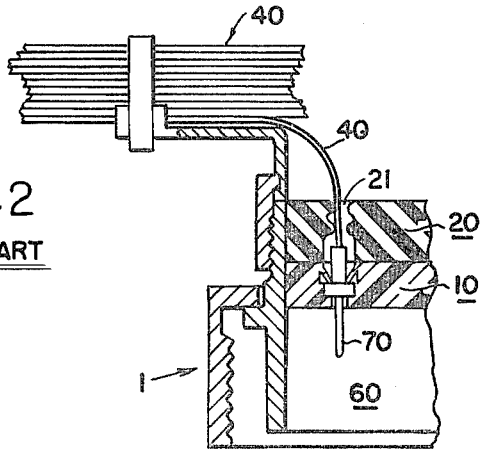
FIG. 2 PRIOR ART

FIG. 2 illustrares an electrical connector assembly 1 wherein the wires 40 exiting the rear end of the connector assembly are pulled at a right angle with respect to one end of the connector. FIG. 2 clearly illustrates the problem associated with moisture sealing grommets 20 when wires 40 are bent at a right angle to the connector and, hence, deviate from the central axis of the passage 21 in the grommet 20. When the wire 40 is deflected from the axis of the passage 21 in the grommet 20 the configuration of the passage 21 is distorted so as to allow moisture to enter the grommet passages and eventually the contact mating area.

Figure 3:
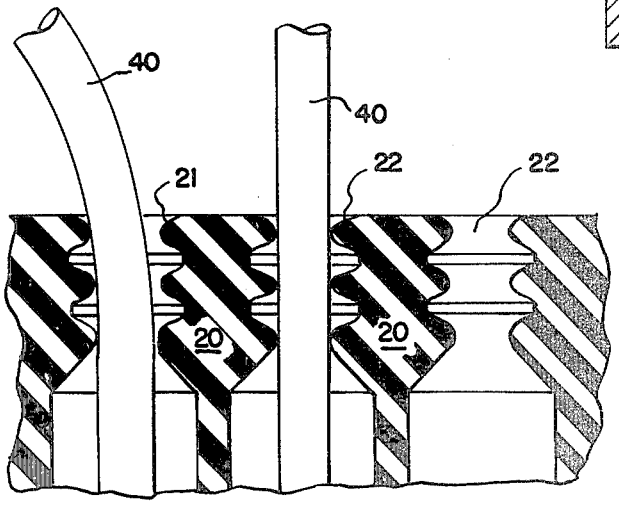
FIG. 3 PRIOR ART

FIG. 3 is an expanded view of a moisture sealing grommet 20 that illustrates the problem associated with a moisture sealing grommet when a wire 40 is deflected from the central axis of a passage 21 in the moisture sealing grommet 20. Passages 21 and 22 have a configuration such that when a wire 40 passes through the passage 20 portions of the passage wall are in pressure contact with the wire 40 to prevent moisture from entering. However, as can be seen with passage 21, when the wire 40 is pulled at an angle to the passage the wire 40 distorts the passage 21 and allows moisture to enter into passage 21 and eventually into the contact mating area.

INVENTION

FIG. 4 illustrates a preferred embodiment of the invention wherein a wire alignment disc 30 is mounted adjacent the moisture sealing grommet 20 to maintain axial alignment of the wire 40 with the passage 22 for a distance sufficient enough to prevent the passage 22 from being distorted. In this embodiment the connector housing 60 has mounted thereon a coupling nut 50 which contains the wire alignment disc 30. The disc 30 includes apertures 31 having a diameter slightly larger than the shoulders of the contacts 70 so the contacts may be inserted through the apertures 31 and into the connector. The coupling nut 50 being connected to the housing 60 by threads 51 on the inside of the coupling nut 50 and threads 61 on the outside of the housing 60. The wire alignment disc 30 is generally comprised of a rigid material such as plastic which is retained within the coupling nut by a snap ring 80 which snaps into groove 53 and captivates the wire alignment disc between the snap ring 80 and a rearwardly facing shoulder 52 in the coupling nut 50. By mounting the wire alignment disc 30 with a snap ring the wire alignment disc is rotatable relative to the coupling nut 50. This allows the coupling nut 50 to be threaded on and off the housing 60 by rotational movement without disconnecting the wires 40 from the contacts 70. Generally, the connector assembly 1 includes contact mounting member 10 and a moisture sealing grommet 20, both of which contain a plurality of passages to allow a plurality of contacts to be arranged within the connector assembly. The contacts 70 are retained within the connector assembly by the insert 10 which includes in each of its passages forwardly facing fingers 11 which engage the enlarged portion of a contact. To assemble the connector the wires 40 are first connected to the contacts 70 which are then passed through apertures 31 in the wire alignment disc. Each contact 70 is then pushed through the moisture sealing grommet 20 and into the contact retaining insert 10 until it snaps into place in front of the contact retaining fingers 11. The coupling nut 50 is then connected to the housing 60.

FIG. 5 illustrates an alternate embodiment of the invention wherein the wire alignment disc 30 is mounted within the connector housing 60. In this embodiment the wire alignment disc 30 is mounted in the housing 60 by a snap ring 80 located in groove 63 in the housing 60 which captivates the wire alignment disc 30 between the snap ring 80 and a rearwardly facing shoulder 62 of the housing 60. In this embodiment the wire alignment disc 30 is removably mounted to allow for removal of the contacts. Also, the disc 30 may be made from a suitable material which will allow the wire alignment disc to be deflected and snapped into a groove in the connector housing 60. The wire alignment disc 30 and the groove in the connector housing may be keyed to prevent rotational movement of the wire alignment disc 30.

While a preferred embodiment of the invention has been disclosed it will be apparent to those skilled in the art that changes may be made to the invention as set forth in the appended claims, and, in some instances, certain features of the invention may be used to advantage without corresponding use of other features. For example, only one mechanism for rotatably mounting the wire alignment disc 30 in a coupling nut 50 is illustrated but other methods (threaded disc) of rotatably mounting the wire alignment disc 30 may be utilized. Accordingly, it is intended that the illustrative and descriptive materials herein be used to illustrate the principles of the invention and not to limit the scope thereof.

Having described the invention, what is claimed is:

1. In combination with an electrical connector of the type having a housing having a front and a rear end, a plurality of mateable electrical contacts, means for mounting said contacts within said housing so that the mating end of said contacts are located at the forward end of said housing, and a moisture sealing grommet comprised of a resilient material having a plurality of longitudinal bores adapted to receive wires entering the rear end of said grommet and terminating at respective contacts, said grommet located adjacent the rear end of said contact mounting means, the improvement comprising:

a wire alignment disc comprised of a rigid material and having a plurality of apertures therein, said apertures having about the same diameter as the bores in said grommet; and means for mounting said wire alignment disc spaced rearwardly from the rear end of said grommet with the apertures in said disc being axially aligned with the bores in said grommet;

said mounting means including the rear end of said housing having an internal wall provided with a shoulder and an annular groove, said shoulder and groove being located adjacent and spaced from said grommet and said disc being mounted between said groove and said shoulder; and a snap ring in said groove captivating said disc between said shoulder and said snap ring, said disc being spaced from the grommet preventing moisture from reaching the contacts by preventing lateral forces acting on the wires.

2. The combination recited in claim 1 wherein said disc is comprised of a thermoplastic material.

3. The combination in claim 1 wherein said disc is rotatably mounted to said coupling nut.

4. The combination recited in claim 3 wherein said means for mounting said coupling nut to one end of said connector housing comprises:

threads on the external surface of one end of said housing; and threads on the internal surface of one end of said coupling nut mateable with the threads on said housing.

5. In combination with an electrical connector of the type having a housing having a forward end and a rear end, a plurality of mateable electrical contacts, means for mounting said contacts within said housing so that the mating ends of said contacts are located at the forward end of said housing and a moisture sealing grommet comprised of a resilient material having a plurality of longitudinal bores adapted to received wires entering the rear end of said grommet and terminating at respective contacts, said grommet located adjacent the rear end of said contact mounting means, the improvement comprising:

a coupling nut including a groove on the inside thereof and an internal shoulder adjacent said groove;

a disc comprised of a rigid material and having a plurality of apertures therein arranged in the same spaced relationship as the bores in said grommet, said disc being located between said groove and said shoulder in said coupling nut and having about the same diameter as said bores;

means for mounting said coupling nut to one end of said connector housing; and means for mounting said disc to said coupling nut, said mounting means including a snap ring being disposed in said groove in said coupling nut to retain said disc between said snap ring and said shoulder, whereby when said coupling nut is mounted to said connector housing, said disc is adjacent and spaced from the rear end of said grommet.

6. In combination with an electrical connector of the type having a housing having a front mating end and a rear end, a plurality of electrical contacts mounted within the housing and resilient means for sealing the contacts from moisture, said resilient means having a plurality of longitudinal wire receiving bores adapted to receive wires entering the connector housing from the rear end and terminating with respective contacts, the improvement comprising:

a rigid wire alignment disc having a plurality of apertures therein; and mounting means for spacing the disc from the resilient means and aligning the apertures in said disc with the wire receiving bores, said mounting means including:

said housing rear end including an interior wall spaced rearwardly of the resilient means and provided with a shoulder and an annular groove, said disc being located between said groove and said shoulder; and a snap-ring disposed in said groove captivating said disc between the shoulder and the snap ring.

7. An electrical connector comprising:

a housing having a front end, a rear end and an inner wall adjacent the rear end;

a dielectric retainer disposed within said housing;

a plurality of mateable electrical contacts retained within the dielectric retainer so that the mating end of said contacts are located at the front end of said housing;

a moisture sealing grommet comprised of a resilient material and having a plurality of longitudinal bores adapted to receive wires entering the rear end of said grommet and terminating at respective contacts, said grommet located adjacent at the rear end of the housing and adjacent to the dielectric retainer;

a wire alignment disc having a plurality of apertures therein with the apertures in said disc being aligned with the bores in said grommet;

the inner wall of said housing including a shoulder and a groove located rearwardly from said grommet and in spaced apart relation with said disc being mounted between said groove and said shoulder; and a snap ring in said groove captivating said disc between said shoulder and said snap ring;

whereby spacing said wire alignment disc from the rear end of said grommet and aligning the disc apertures with the grommet bores prevents the wires from deflecting laterally, thereby preventing the bores from deflecting and moisture from entering the grommet bores.

* * * * *